US008204420B2

(12) United States Patent
Carr, Jr. et al.

(10) Patent No.: US 8,204,420 B2
(45) Date of Patent: Jun. 19, 2012

(54) FUSER WITH END CAPS HAVING PROTUBERANCES FOR REDUCING BELT SKEW

(75) Inventors: Patrick Wayne Carr, Jr., Corinth, KY (US); Gregory Daniel Creteau, Winchester, KY (US); Hnshikesh Pramod Gogate, Lexington, KY (US); Larry Steven Foster, Lexington, KY (US); David Erwin Rannick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 843 days.

(21) Appl. No.: 12/200,156

(22) Filed: Aug. 28, 2008

(65) Prior Publication Data

US 2010/0054827 A1 Mar. 4, 2010

(51) Int. Cl.
*G03G 15/20* (2006.01)

(52) U.S. Cl. ..... 399/329

(58) Field of Classification Search ..... 399/328, 399/329, 330, 320, 122
See application file for complete search history.

(56) References Cited

U.S. PATENT DOCUMENTS

2005/0220509 A1* 10/2005 Kubochi et al. ..... 399/329
* cited by examiner

*Primary Examiner* — David Gray
*Assistant Examiner* — Billy J Lactaoen

(57) ABSTRACT

A fuser has a heater housing extending through an endless belt with end caps on the housing adjacent to opposite lateral sides of the belt. The end caps have inner flanges spaced radially outward from a center portion and radially inward from the opposite marginal side edge portions of the belt so as to define clearance therebetween. Protuberances on the inner flanges of the end caps project toward opposite marginal edge portions of the belt and are circumferentially spaced apart to reduce belt skew relative to the end caps by either decreasing the surface area of contact of the inner flanges with the opposite marginal side edge portions of the belt to reduced surface areas of contact of protuberances therewith or decreasing the radial height of the clearance between the inner flanges and opposite side edge portions of the belt to the reduced radial height between the latter and the protuberances.

20 Claims, 6 Drawing Sheets

NO FEATURE

FEATURE SEPARATE

FEATURE INTEGRAL

μ = COEFFICIENT OF FRICTION
$\Theta_t$ = TOTAL BAND LAP ANGLE (RAD)
$T_1$ = TENSION (N)
$T_2$ = TENSION (N)

$$T_1 / T_2 = e^{\mu \Theta_t}$$

FUSER WITH END CAPS HAVING PROTUBERANCES FOR REDUCING BELT SKEW

BACKGROUND

1. Field of the Invention

The present invention relates generally to image forming machines and, more particularly, to a fuser for an image forming machine with end caps having protuberances strategically placed on an inner flange for reducing belt skew.

2. Description of the Related Art

An image forming machine, such as a printer, copier, fax machine, all-in-one device or a multifunctional device, typically includes a heating device, such as a fuser, to fix a developing agent, such as toner, to a media sheet. The fuser typically contains a heater and an endless belt and backup pressure roll that form a nip for the media sheet to pass through. They provide heat and/or pressure to the toner to soften the toner so that it will adhere to the media sheet. The fuser belt defines an inner loop. The heater is positioned within the inner loop and in direct contact with the belt. The heater has a profile generally corresponding to the travel path of the belt to provide an area contact rather than a line contact for more efficient thermal transfer. The heater is in the form of a ceramic heater held in a heater housing positioned within the inner loop and against the belt. The fuser belt is an "idling belt" having no drive rolls within it. The belt is driven by the rotation of the backup pressure roll, through the driving association of the belt with the pressure roll at the nip.

The location of the belt is controlled by an end cap attached to each end of the heater housing. The end cap has an inner flange that limits the left to right axial movement of the belt. The backup pressure roll rotates which, in turn, rotates the belt and drives the print media through the fuser nip. The end caps do not rotate.

Sometimes the belt in the fuser skews with respect to the fuser backup pressure roll and the end caps. The belt skew results from differences in friction along the heater. This misalignment allows the belt to infringe on the media path as it enters the fuser nip causing smudging on the printed page that results in unacceptable print quality. Another phenomenon that belt skew affects is the "left to right" movement of the media as it passes through the fuser nip. This is known as "media walk" and is defined as the distance in millimeters the paper moves side to side. Excessive media walk may cause the media to crash into limiting features within the printer's paper path.

Thus, there is still a need for an innovation that will reduce skew between the end caps and the belt so as to reduce belt skew with the backup pressure roll.

SUMMARY OF THE INVENTION

The present invention meets this need by providing an innovation that strategically places features in the form of protuberances on the inner flange of each of the end caps that reduce the amount of belt skew by reducing the clearance between the inner flange of the end cap and the belt and also reducing the area of surface contact between the inner flange and the belt.

Accordingly, in an aspect of the present invention, a fuser for an image forming machine includes an endless belt having opposite marginal side edge portions and opposite exterior and interior surfaces on the belt extending between the opposite marginal side edge portions, a heater housing disposed within the endless belt such that the interior surface thereof surrounds the housing lengthwise between opposite ends of the housing, a pair of end caps mounted to opposite ends of the housing adjacent to opposite lateral sides of the belt, each of the end caps having an inner flange spaced radially outward from a center portion of the end cap and radially inward from the opposite marginal side edge portions of the belt so as to define a clearance of a first radial width between the inner flange and the one of the opposite marginal side edge portions of the endless belt, and a plurality of protuberances defined on the inner flange of each of the end caps projecting toward the one of the opposite marginal edge portions of the endless belt and circumferentially spaced apart from each other to reduce belt skew relative to the end caps by enabling at least one of: decreasing the surface area of contact of the inner flange of the end cap with the one of the opposite marginal side edge portion of the endless belt to the reduced surface area of contact of the protuberances with the one of the opposite marginal side edge portions of the belt or decreasing the radial height of clearance between the inner flange and the one of the opposite side edge portions of the belt to the reduced radial height between the one marginal side edge portion of the belt and the protuberances.

BRIEF DESCRIPTION OF THE DRAWINGS

Figure 1:
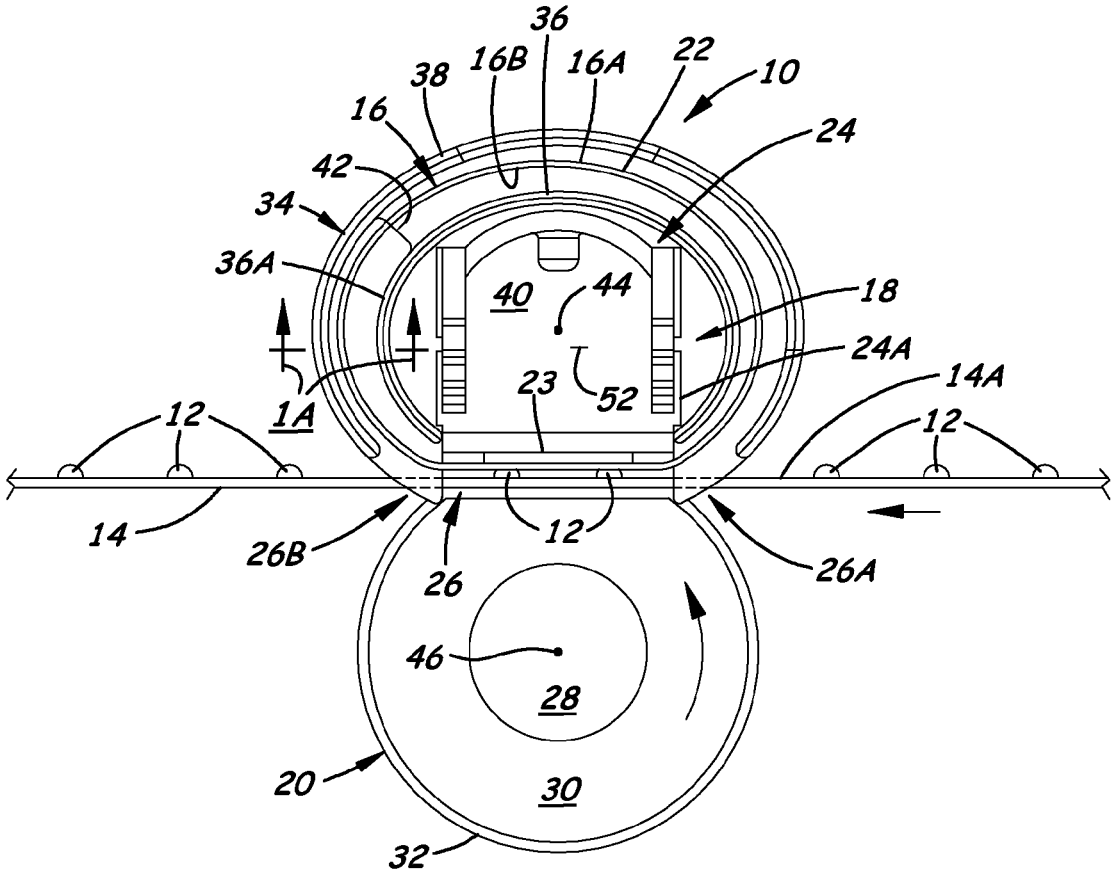

Having thus described the invention in general terms, reference will now be made to the accompanying drawings, which are not necessarily drawn to scale, and wherein:

FIG. 1 is a schematic end view of an exemplary embodiment of a fuser of an image forming machine with a media sheet having toner thereon traveling through a nip between an endless belt and a backup pressure roll of the fuser.

Figure 1A:
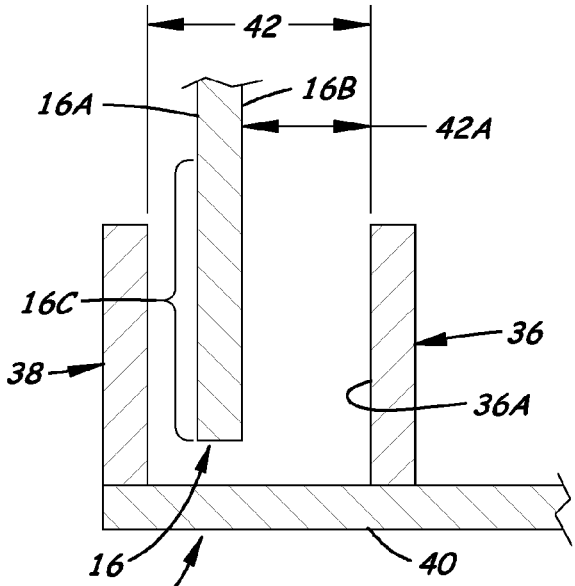

FIG. 1A is an enlarged fragmentary sectional view of an end cap of the fuser as seen along line 1A-1A of FIG. 1 showing inner and outer flanges of the end cap and a marginal side edge portion of an endless belt of the fuser extending into the clearance between the flanges and containing no feature.

Figure 2:
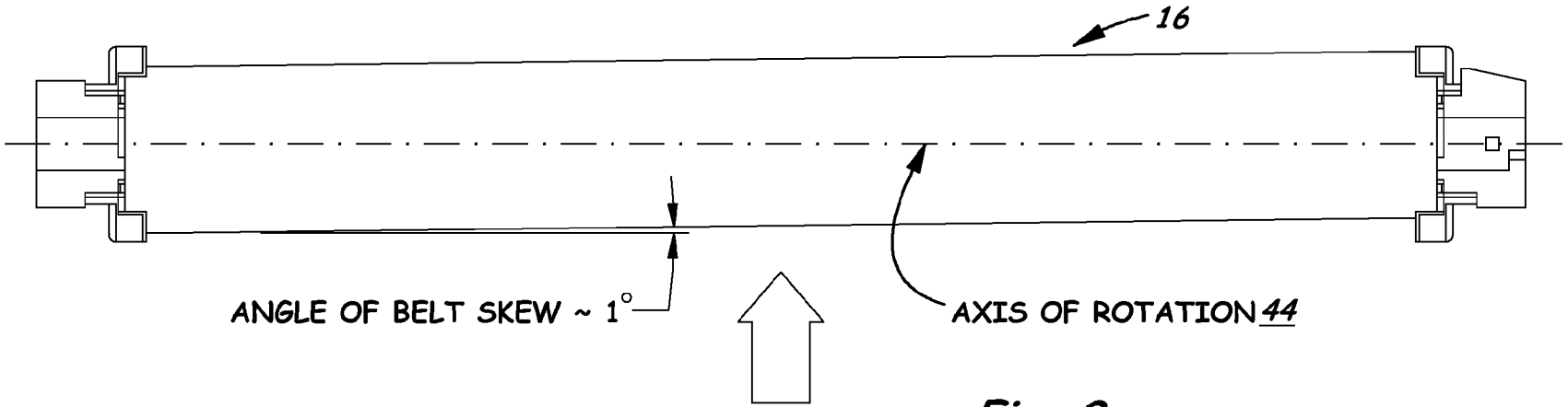

FIG. 2 is a schematic side elevational view of the belt showing the angle of belt skew at approximately 1°.

Figure 3:
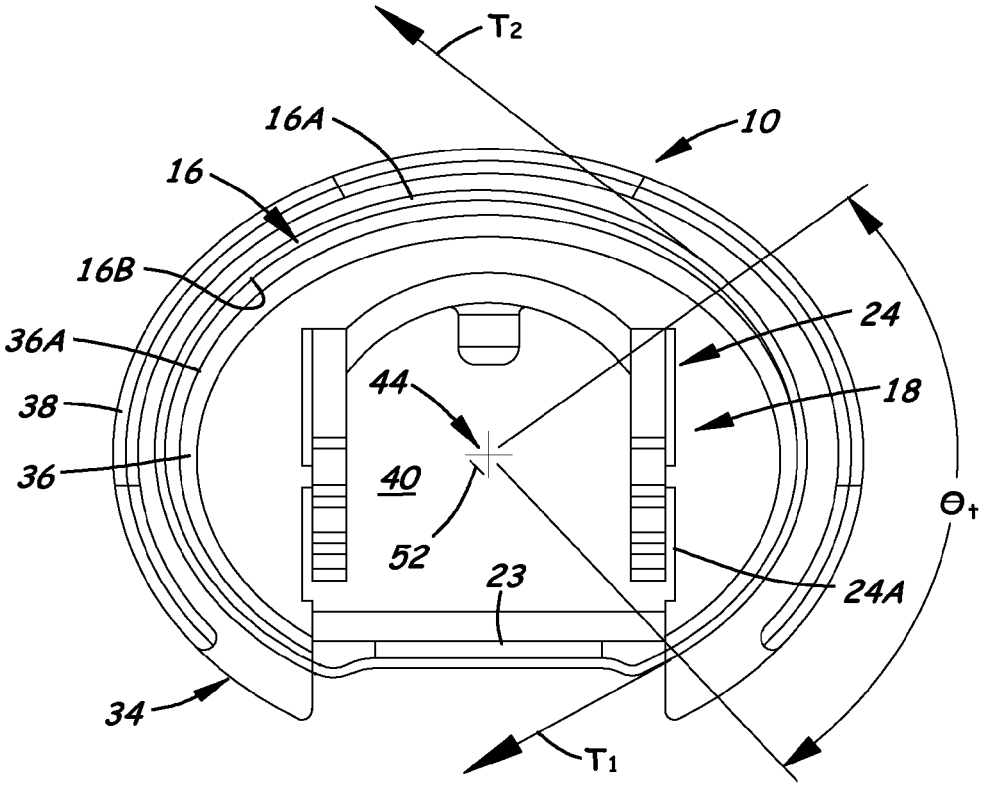

FIG. 3 is an enlarged schematic end view of the belt showing too much contact of the inner flange of the end cap with the belt, resulting in high friction in small local areas of the belt which produces adverse effects on the belt.

Figure 4A:
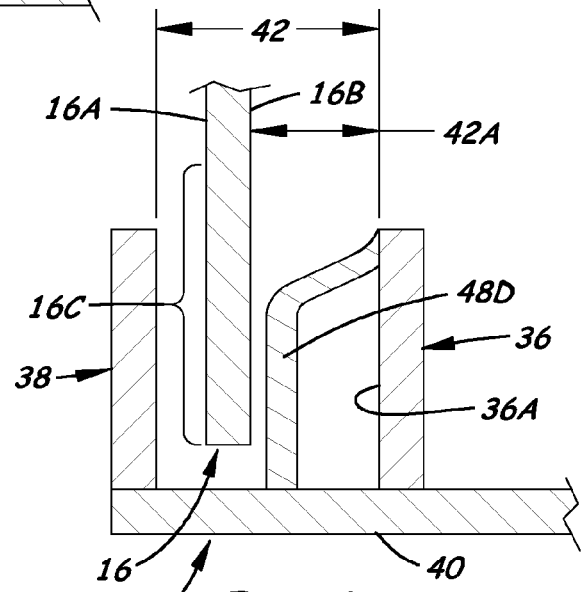
Figure 4B:
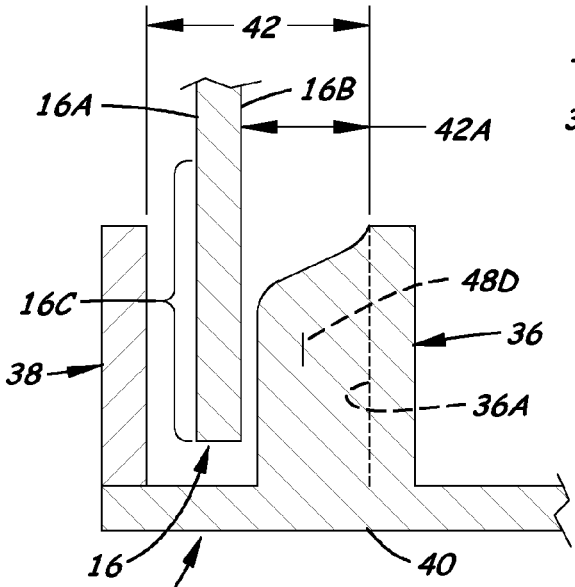
Figure 4:
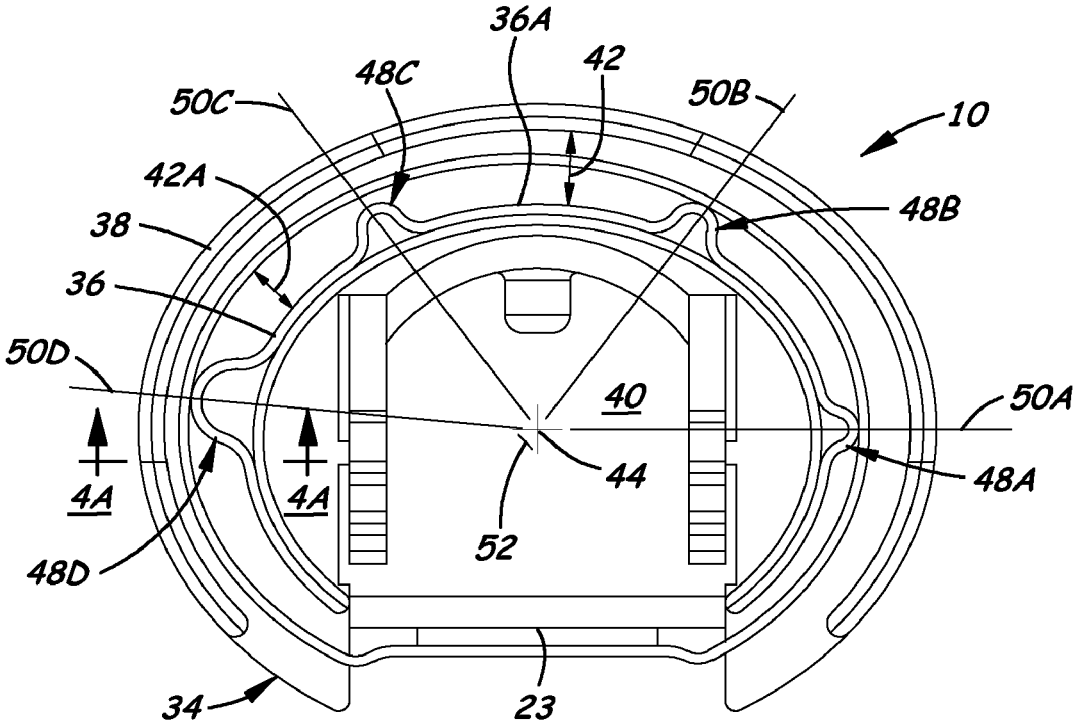

FIG. 4 is a view of the belt similar to that of FIG. 3 but now showing the inner flange of the end cap having features of the present invention strategically located or place on the inner flange about the clearance between it and the belt.

FIG. 4A is a view of the end cap similar to that of FIG. 1A now showing a feature or protuberance separately provided on the inner flange and underlying the marginal side edge portion of the endless belt.

FIG. 4B is a view similar to that of FIG. 4A but now showing a feature or protuberance integrally formed on the inner flange and underlying the marginal side edge portion of the endless belt.

Figure 5:
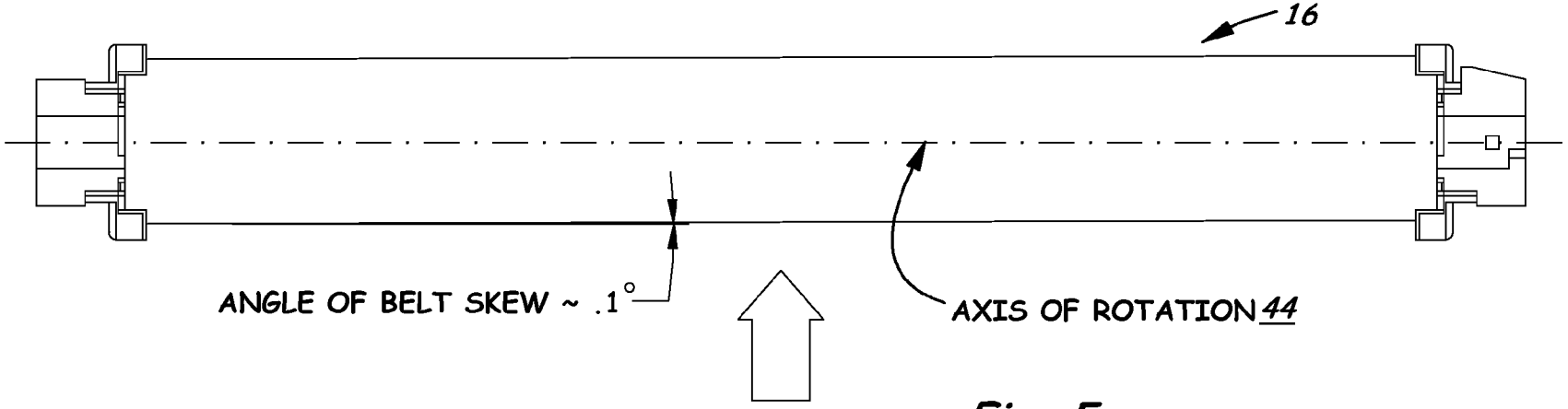

FIG. 5 is a view of the belt similar to that of FIG. 2 but now showing the angle of belt skew reduced to approximately 0.1°.

Figure 6:
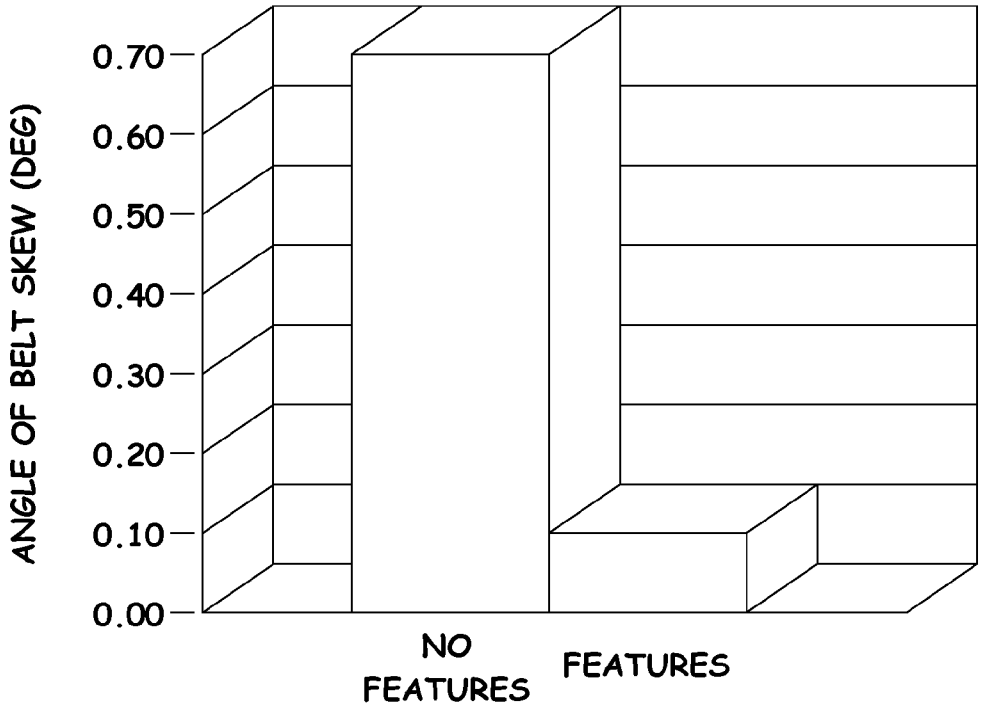

FIG. 6 is a bar graph of the angle of belt skew with and without features of the present invention.

Figure 7:
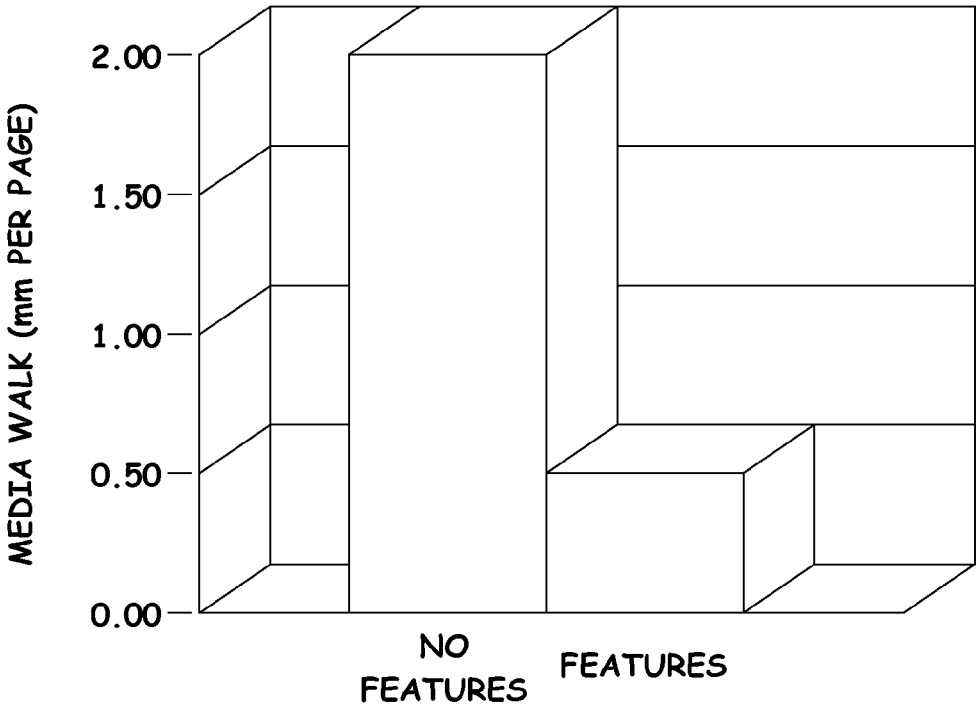

FIG. 7 is a bar graph of the amount of media walk per page with and without the features of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated an exemplary embodiment of a fuser, generally designated 10, of an image forming machine (not shown). The fuser 10 fixes or fuses toner particles 12 defining an image to a media sheet 14. Toner particles 12 may be monochrome particles or particles of different colors (e.g., cyan, magenta, yellow and/or black particles). The fuser 10 includes an endless belt 16, a heater 18 and a backup pressure roll 20. The belt 16 defines an inner loop 22 having a metal tube and, to improve the degree to which the belt conforms to the varying heights of the various piles of toner particles, a compliant rubber layer on the base and a release coating covering the rubber layer to enhance thermal conductivity. More specifically, the belt 16 is typically a Teflon® coated, silicone rubber molded over a flexible metal tube.

The heater 18 is positioned within the inner loop 22 and in direct contact with the endless belt 16. The heater 18 has a profile (e.g., flat or curved) generally corresponding to the travel path of the belt 16 to provide an area contact rather than a line contact for more efficient thermal transfer. The heater 18 may be in the form of a ceramic heater component held in a heater housing 24 positioned within the inner loop 22 of and against the belt 16. The belt 16 is somewhat loosely fit around the heater housing 24, which is a high-temperature plastic body made of a liquid crystal polymer, in one example about 22% glass and mineral filled but not limited to this combination.

The backup pressure roll 20 defines a nip 26 with the belt 16 through which the print media sheet 14 travels. The nip 26 has an entrance 26A and an exit 26B. The belt 16 is positioned adjacent the toner side 14A of the sheet 14 as it is transported through the nip 26, with the pressure roll 20 on the opposite side thereof. As known to those skilled in the art, the backup pressure roll 20 includes a metal core 28, a compliant layer 30 surrounding the core 28, and a release layer 32 surrounding the compliant layer 30. The metal core 28 may be formed from a suitable metal that provides structural rigidity and stores thermal energy, such as extruded aluminum or steel. The compliant layer 30 may be formed from a material providing compliance of pressure roll 20, and can be in the form of silicone rubber, but may be formed of other resilient materials. Additionally, the release layer 32 may be in the form of a sleeve made from a material providing suitable release properties.

The endless belt 16 is a so-called "idling belt" having no drive rolls within its inner loop 22. The belt 16 is driven by the rotation of the backup pressure roll 20 through the driving association of the belt 16 therewith in the nip 26. The print media sheet 14 is transported to the fuser 10 by a transport belt (not shown), and passes through the nip 26. During printing, the fuser 10 fixes or fuses the toner particles 12 to the toner side 14A of the print media sheet 14. The heater 18 positioned within the inner loop 22 of the endless belt 16 is energized such that the heater 18 provides a desired heat output. Heat is transferred principally via conduction from the heater 18, through the belt 16, and to the outer periphery of the backup pressure roll 20. The outer surface 16A of the belt 16 is also the surface that transfers heat to toner particles 12, for fixing or fusing an image on the print media sheet 14. The print media sheet 14 is transported through the nip 26 between the backup pressure roll 20 and the belt 16. Heat is transferred from the belt 16 to toner particles 12, to fix or fuse the image on the sheet 14, and is additionally transferred to the backside of the sheet 14 from the pressure roll 20, to assist in the fusing process. The compliant rubber layer of the belt 16 accommodates the varying thickness of toner particles 12 on the print media sheet 14.

The fuser 10 also includes end caps 34 (one being shown at the one end of the fuser 10 shown in FIGS. 1, 3 and 4 and fragmentarily shown in FIGS. 1A and 4A) attached to opposite ends 24A of the heater housing 24 and by which means the side-to-side location of the belt 16 is controlled. Each end cap 34 has a substantially circular inner flange 36 that fits inside of the inner loop 22, the inside diameter, of the belt 16 with an outer surface 36A of the inner flange 36 to locate the belt 16 up and down and front to back in the fuser 10. The outer surface 36A of the inner flange 36 of the end cap 34 is shaped to match the shape or configuration the belt 16 (as viewed from an end as seen in FIGS. 1, 3 and 4) wants to take when the belt 16 is pressed up against the heater 18 by the backup pressure roll 20. The inner flange 36 of the end cap 34 limits the left to right axial movement of the belt 16. The end cap 34 also has an outer flange 38. As best seen in FIGS. 1A and 4A, both inner and outer flanges 36, 38 project in the same direction from an end panel 40 of the end cap and a clearance 42 is defined between the inner and outer flanges 36, 38 due to their being spaced apart radially from one another. As mentioned above, the endless belt 16 is an idler; it is only rotated due to the pressure and angular forces applied to it by the rotation of the backup pressure roll 20 in driving the print media sheet 14 through the fuser nip 26. The end caps 34 do not rotate.

As seen in FIG. 2, heretofore it has been noted that the belt 16, and thus its central axis 44 (see also FIG. 4) in the fuser 10 can skew with respect to the rotational axis 46 of the backup pressure roll 20 and to the end caps 34. Belt skew is believed to result from differences in friction between the heater 18 and belt 16 along the length of the heater 18. The angle of the belt skew relative to the axis 46 of the backup roll 20 can be up to approximately 1°. Though this degree of belt skew may seem slight it can have large consequences. This misalignment allows the belt 16 to infringe on the media path as it enters the fuser nip 26 at entrance 26A causing smudging on the printed sheet 14 that results in unacceptable print quality. Another phenomenon that belt skew affects is the "left to right" movement of the media sheet 14 as it passes through the fuser nip 26. This is known as "media walk" and is defined as the distance in millimeters the sheet 14 moves side to side. Excessive media walk may cause the media to crash into limiting features within the printer's paper path.

When too much of the surface of the inner flange 36 comes in contact with the belt 16, as depicted in FIG. 3, this condition could cause what is termed "Band Brake" effect. This would result in high friction in very small local areas of the belt 16. In this case two phenomenons could occur. The first is that the increased friction would cause the belt 16 to stop momentarily. This stoppage would result in a print quality defect on the print page. The second would be catastrophic belt failure or destruction due to extremely high torque placed on the belt 16. This would render the printer inoperative.

To minimize friction with the inner surface 16B of the belt 16 a portion of the clearance 42 provided between the inner and outer flanges 36, 38 is also between the inner surface 16B of one of the opposite marginal edge portions 16C of the belt 16 and the outer surface 36A of the inner flange 36, as seen in FIG. 1A. It should be noted that the clearance 42 between the inner and outer flanges 36, 38 of the end cap 34 and the marginal side edge portions 16C of the metal belt 16 is important to the performance of the fuser 10 when it is a color fuser. The amount of the clearance 42, side-to-side, is what allows the belt 16 to skew. This clearance 42 allows the belt central axis 44 to not be parallel to the backup roll axis of rotation 46. The relative angle between these axes 44, 46 creates a point load at the contact point of the belt 16 and the end cap 34. In addition to accelerated wear due to this point load, another failure mode is caused by this point load. This point load can produce a localized buckling of the belt 16 as it contacts the end cap 34. This buckling usually results in the belt 16 bending over short distances. Since it is localized the buckling fatigues the edge of the belt 16 and can put a crease in the belt 16. Buckling results in fatigue of the belt 16 which results in cracks in the belt 16 in the axial direction and circumferential direction. These cracks cause failure of the belt 16.

The present invention is directed to features provided on the inner flange 36 of the end cap 34 which reduce the amount of belt skew by taking up or reducing portions of the clearance 42 that exists between the opposite marginal side edge portions 16C of the endless belt 16 and the inner flanges 36 of the end cap 34. In an exemplary embodiment as seen in FIGS. 4 and 4A, these features take the form of a plurality of dimples or protuberances 48A-48D formed on the inner flange 36 of the end cap 34 which are circumferentially spaced from one another and project outward along radial lines 50A-50B from a central portion 52 of the end cap 34. The profile of the number and shapes of protuberances 48A-48D and their circumferential and radial positions when taken together and also their total surface contact areas may be tailored so as to conform to the profile of the path of travel of the endless belt 16 and reduce the radial height of the clearance 42 between the inner flange 36 and the belt 16 and the amount of the surface area of the inner flange 36 to come in contact with the belt 16. Thus the spacing or distance between the protuberances 48A-48D is important so that the "Band Brake" phenomenon does not occur because of too much frictional contact, as also shown and described in FIG. 3.

In FIGS. 4A and 4B, there is shown the protuberances 48A-48D provided in alternative designs in the inner flange 36 with respect to how they reduce the radial height of the clearance 42 between the inner flange 36 of the end cap 34 and the inside of the metal belt 16. These features or protuberances 48A-48D are strategically positioned circumferentially around the inner flange 36 of the end cap 34, as best seem in FIG. 4, where the radius of the belt 16 is closest to the natural radius of the belt 16 under zero loading so that no additional stresses are imposed on the metal belt 16. Because the clearance portion 42A is lesser at locations nearer the entrance 26A to the nip 26 than at locations nearer the exit 26B from the nip 26, which in part at least may be due to the fact that the direction of the pulling force exerted on the belt 16 goes from the entrance 26A toward the exit 26B of the nip 26, the radial projection beyond the inner flange 36 of the one of the protuberances 48A-48D, as viewed along radial lines 50A-50D, nearer to the entrance 26A may be less than the radial projection beyond the inner flange 36 of the one of the protuberances 48A-48D nearer to the exit 26B. Also, the protuberances 48A-48D going from the entrance 26A to the exit 26B may increase in radial height as the height of the clearance 42 between the belt 16 and inner flange 36 increases. In such manner, the profile of the protuberances 48A-48D when taken together are tailored to correspond to the height of the clearance 42 at these locations and to the profile of the path of travel of the endless belt 16. The protuberances 48A-48D can be features integrally molded, as seen in FIG. 4B, on the inner flange 36 of the end cap 34 or features separately provided, as seen in FIG. 4A, on an insert made from plastic or metal material that is attached to the end cap 34, such as between the end panel 40 and the inner flange 36.

To recap, the present invention is directed to features taking the form of dimples, protrusions or bulges, referred to generically as protuberances 48A-48D, on the inner flange 36 of the end cap 34 that control belt skew. Thus, point loads of the belt 16 on the end cap 34, due to the angle $\theta_t$ between the belt 16 and end cap 34 as depicted in FIGS. 3 and 4, or run-out of the belt 16 can be compensated for resulting in elimination of belt end flaring and thus damage. These features control the front to back axial motion of the belt 16 and reduce the amount of media sheet walk rate which can cause the media sheets 14 to crash into limiting features within the printer's paper path. Improved control of belt skew with the implementation of protuberances 48A-48D compared to the situation without them is clearly illustrated in FIG. 5 and in the bar graph of FIG. 6 which show that the angle of belt skew is reduced to approximately 0.1° The improved media walk rate is shown in the bar graph of FIG. 7.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A fuser for an image forming machine, comprising:

an endless belt having opposite marginal side edge portions and opposite exterior and interior surfaces on said belt extending between said opposite marginal side edge portions;

a heater housing disposed within said endless belt such that said interior surface thereof surrounds said housing lengthwise between opposite ends of said housing;

a pair of end caps mounted to opposite ends of said housing adjacent to opposite lateral sides of said belt, each of said end caps having an inner flange spaced radially outward from a center portion of said end cap and radially inward from said opposite marginal side edge portions of said belt so as to define a clearance with radial height between said inner flange and said one of said opposite marginal side edge portions of said endless belt; and a plurality of protuberances defined on said inner flange of each of said end caps projecting toward said one of said opposite marginal edge portions of said endless belt and circumferentially spaced apart from each other to reduce belt skew relative to said end caps by enabling at least one of decreasing the surface area of contact of said inner flange of said end cap with said one of said opposite marginal side edge portions of said endless belt to the reduced surface areas of contact of said protuberances with said one of said opposite marginal side edge portions of said belt and decreasing the radial height of the clearance between said inner flange and said one of said opposite side edge portions of said belt to the reduced radial height between said one marginal side edge portion of said belt and said protuberances.

2. The fuser of claim 1 wherein the profile of said protuberances of each of said end caps in their respective shapes and numbers when taken together are tailored to conform to the shape of said one of said opposite marginal side edge portions of said belt so as to reduce the surface area of said inner flange that comes in contact with said belt.

3. The fuser of claim 1 wherein the profile of said protuberances of each of said end caps in their respective circumferential and radial positions when taken together are tailored to conform to the shape of said one of said opposite marginal side edge portions of said belt so as to reduce the surface area of said inner flange that comes in contact with said belt.

4. The fuser of claim 1 wherein at least some of said protuberances are at different heights from said inner flange of said end cap.

5. The fuser of claim 1 wherein all of said protuberances are at different radial heights from said inner flange of said end cap.

6. The fuser of claim 1 wherein said protuberances project outwardly from said inner flange along radial lines extending substantially from said central portion of said end cap.

7. The fuser of claim 1 wherein said protuberances are integrally molded in said inner flange of said end cap.

8. The fuser of claim 1 wherein said protuberances are made from one of a plastic or metal material attached to said end cap.

9. A fuser for an image forming machine, comprising:

an endless belt having opposite marginal side edge portions and opposite exterior and interior surfaces on said belt extending between said opposite marginal side edge portions;

a backup pressure roll disposed along a portion of said endless belt and making rotational contact therewith so as to cause rotation of said endless belt and form a nip therewith having an entrance and an exit;

a heater housing disposed within said endless belt such that said interior surface thereof surrounds said housing lengthwise between opposite ends of said housing and as said endless belt is rotated about said housing;

a pair of end caps mounted to opposite ends of said housing adjacent to opposite lateral sides of said belt, each of said end caps having an inner flange spaced radially outward from a center portion of said end cap and radially inward from said opposite marginal side edge portions of said belt so as to define a clearance with radial height between said inner flange and said one of said opposite marginal side edge portions of said endless belt as said belt rotates relative to said end caps; and a plurality of protuberances defined on said inner flange of each of said end caps projecting toward said one of said opposite marginal edge portions of said endless belt and circumferentially spaced apart from each other to reduce belt skew relative to said end caps by enabling at least one of decreasing the surface area of contact of said inner flange of said end cap with said one of said opposite marginal side edge portions of said endless belt to the reduced surface areas of contact of said protuberances with said one of said opposite marginal side edge portions of said belt and decreasing the radial height of the clearance between said inner flange and said one of said opposite side edge portions of said belt to the reduced radial height between said one marginal side edge portion of said belt and said protuberances.

10. The fuser of claim 9 wherein said clearance is less nearer to the location of said entrance to said nip than when nearer to the location of said exit from the said nip such that the radial projections of said protuberances nearer to the location of said entrance are less than when nearer to the location of said exit and in such manner the profile of said protuberances when taken together are thereby tailored to correspond to the width of said clearance at said locations.

11. The fuser of claim 10 wherein said protuberances going from said entrance to said exit of said nip increase in radial height from said inner flange as the radial height of said clearance between said belt and said inner flange increases.

12. The fuser of claim 9 wherein the profile of said protuberances of each of said end caps in their respective shapes and numbers when taken together are tailored to conform to the shape of said one of said opposite marginal side edge portions of said belt so as to reduce the surface area of said inner flange that comes in contact with said belt.

13. The fuser of claim 9 wherein the profile of said protuberances of each of said end caps in their respective circumferential and radial positions when taken together are tailored to conform to the shape of said one of said opposite marginal side edge portions of said belt so as to reduce the surface area of said inner flange that comes in contact with said belt.

14. The fuser of claim 9 wherein at least some of said protuberances are at different radial heights from said inner flange of said end cap.

15. The fuser of claim 9 wherein all of said protuberances are at different radial heights from said inner flange of said end cap.

16. The fuser of claim 9 wherein said protuberances project outwardly from said inner flange along radial lines extending substantially from said central portion of said end cap.

17. The fuser of claim 9 wherein said protuberances are integrally molded in said inner flange of said end cap.

18. The fuser of claim 9 wherein said protuberances are made from one of a plastic or metal material attached to said end cap.

19. The fuser of claim 1 wherein said clearance is less nearer to the location of an entrance to a nip of said fuser than when nearer to the location of an exit from the said nip such that the radial projections of said protuberances nearer to the location of said entrance are less than when nearer to the location of said exit and in such manner the profile of said protuberances when taken together are thereby tailored to correspond to the width of said clearance at said locations.

20. The fuser of claim 19 wherein said protuberances going from said entrance to said exit of said nip increase in radial height from said inner flange as the radial height of said clearance between said belt and said inner flange increases.

* * * * *